US005901117A

United States Patent [19]

Delabre

[11] Patent Number: 5,901,117

[45] Date of Patent: May 4, 1999

[54] WATCH FRAME COMPRISING A CASE AND A SUPPORTING DEVICE

[75] Inventor: Guy Delabre, Portalban, Switzerland

[73] Assignee: Comadur S.A., Le Locle, Switzerland

[21] Appl. No.: 09/077,300

[22] PCT Filed: Sep. 26, 1997

[86] PCT No.: PCT/CH97/00365

§ 371 Date: Jun. 1, 1998

§ 102(e) Date: Jun. 1, 1998

[87] PCT Pub. No.: WO98/14839

PCT Pub. Date: Apr. 9, 1998

[51] Int. Cl.[6] ..... G04B 37/60

[52] U.S. Cl. ..... 368/276; 368/281; 368/309

[58] Field of Search ..... 368/88, 276, 281, 368/291–296, 299, 300, 309

[56] References Cited

U.S. PATENT DOCUMENTS

| | | | |
|---|---|---|---|
| 4,390,288 | 6/1983 | Arnoux | 368/276 |
| 4,464,063 | 8/1984 | Goghiat | 368/276 |
| 4,620,798 | 11/1986 | Scarzini | 368/276 |
| 4,696,577 | 9/1987 | Muller et al. | 368/276 |
| 4,924,453 | 5/1990 | Ray et al. | 368/294 |

FOREIGN PATENT DOCUMENTS

| | | |
|---|---|---|
| 614 063 | 12/1926 | Germany . |
| 87 16 744 | 2/1988 | Germany . |
| 622 151 | 3/1981 | Switzerland . |
| 632 374 | 10/1982 | Switzerland . |
| 647 121 | 1/1985 | Switzerland . |
| 671 493 | 9/1989 | Switzerland . |
| WO 94 08482 | 4/1994 | WIPO . |

*Primary Examiner*—Vit Miska

*Attorney, Agent, or Firm*—Griffin, Butler, Whisenhunt & Szipl

[57] ABSTRACT

A watch case has a water-tight casing (1) capable of being manufactured economically in hard materials, the casing parts being held assembled by an external support device (2) having structure for attaching the-case to a wristlet or other fixing apparatus. The casing (1) is formed of stacked parts preferably including a crystal (7), an annular middle part (9) and a back cover (8). The mutual contact surfaces (13, 14, 15, 17) of these parts are polished and have no sealing gasket. The support device includes two parallel metal clamps (25) in the form of an open or closed frame, having two portions assembled by screws (28) arranged axially to grip the casing in the clamp. The casing (1) may be made entirely of sapphire, but other materials having zero porosity or a closed structure such as hard metals, ceramics or mineral glass may be used.

20 Claims, 4 Drawing Sheets

WATCH FRAME COMPRISING A CASE AND A SUPPORTING DEVICE

The present invention concerns a watch case including a water resistant casing formed of several stacked parts, which together define a housing intended to contain a watch movement, and a support device which keeps said casing parts assembled, the casing having a transparent upper face, the support device including at least one rigid clamp formed of an upper portion and a lower portion which are removably fixed to each other by assembly means arranged to produce gripping of the casing between the two portions of the clamp in an axial direction, perpendicular to said upper face.

The invention applies more particularly to watch cases whose external casing containing the movement is principally formed of parts made of hard materials which are thus difficult to machine, such as sapphire, the "hard metals" or metal carbides, ceramics or even mineral glass.

U.S. Pat. No. 4,390,288 discloses a watch case of this type, wherein the crystal and the back cover are made of hard material such as sapphire and pressed against the middle part by external clamps provided with gripping screws. The upper and lower surfaces of the middle part each have, for their junction respectively with the crystal or the back cover, a rabbet and a groove for a sealing gasket. The middle part also includes two pairs of horns for attaching a wristlet. It is clear that a middle part thus formed cannot be economically manufactured in a hard material. Moreover, the fact that the sealing gaskets are clearly visible through the crystal and the back cover made of sapphire is detrimental to the aesthetics of the watch case.

Another watch case of this kind is disclosed in CH Patent No 622 151 where it is mentioned that the use of hard scratch proof materials for making various parts of watch cases poses numerous manufacturing problems. Since machining of such materials is difficult, the design and execution of assembling the various parts of the case, the sealing and aesthetic appearance of the case, especially when transparent or translucent materials are used, require special solutions. Generally, one seeks to reduce to a minimum machining of recesses or holes, which is particularly expensive, and to use simple external shapes, which are easier to polish.

The watch case disclosed in CH Patent No 622 151 essentially consists of three parts stacked axially, namely a substantially flat metal back cover provided with four horns for attaching a wristlet, an annular middle part made of a hard material, and a crystal formed by an entirely flat sapphire plate. The middle part is fixed to the back cover by means of axial screws passing into holes in these two parts. Then the crystal, provided with a metallized strip along the edge of its lower face, is glued to the middle part so as to cover the heads of the screws and assure a water-tight connection. Sealing of the back cover is assured by a conventional annular sealing gasket housed in a recess of the metal back cover.

One drawback of this design obviously lies in the cost of machining through holes in the middle part. Moreover, the numerous machining operations necessary on the back cover prevent the economical manufacture thereof in a hard material, for example the same material as the middle part, which would be more aesthetically pleasing. If the material of the middle part is translucent, the screws which it contains and the sealing gasket can unfortunately be seen. Finally, the fact that the wristlet attachment horns are situated in the vicinity of the back cover is detrimental to the aesthetic appearance of the watch.

CH Patent No 632 374 discloses a watch case whose casing is formed of two parts made of transparent or translucent mineral material, one of which is a hollowed part forming the crystal and the middle part, and the other is a flat back cover assuring sealing of the case via a sealing gasket housed in a groove of the middle part. These two parts are held together by means of two opposite metal elements each having two horns for attaching a wristlet. Each element has an upper claw and a lower claw between which the two parts of the casing are gripped via a spring. Each element is glued to the lateral face of the middle part, so that it cannot be dismantled and must resist the traction of the wristlet. The case can only be opened and closed by sliding the back cover laterally, which risks damaging the sealing gasket. Other drawbacks are that the sealing gasket is visible through the transparent parts and the groove would be very difficult to make if the middle part had to be made of a hard material such as sapphire.

An object of the present invention is substantially to avoid the aforementioned drawbacks, by providing a water resistant watch case having a casing capable of being manufactured at an acceptable cost in hard materials and whose sealing can be assured by simple and reliable means. A particular object consists of providing a case of high aesthetic value, in particular if the casing is principally made of transparent or translucent materials such as sapphire or mineral glass, which allow the clockwork movement to be seen, but hide as far as possible the other elements, such as fixing or sealing means within the case.

According to the invention, a watch case of the type indicated in the preambule is provided, characterized in that said casing parts are made of materials having zero porosity or a closed structure and have, facing each other, mutual contact surfaces which are flat or generated by revolution and are polished, no sealing gaskets being inserted between them.

Consequently, manufacture of the casing parts is particularly simplified, since machining of flat contact surfaces or contact surfaces generated by revolution is simpler and less expensive than for any other type of surface. Nonetheless, the axial clamping realized perpendicular to these surfaces by the external support device, which preferably includes screws arranged in the axial direction, guarantees that the casing is held well and reliable sealing over the contact surfaces. In particular with hard materials having zero porosity or a closed structure, sealing of the casing is assured simply by the fact that the mutual contact surfaces of the casing parts are non-porous and polished, without any sealing gasket being inserted between them. Not only is machining simplified due to the absence of interlocking elements or grooves in the mutual contact zones of the parts, but the aesthetic appearance is also much better since such elements or a sealing gasket such as an O-ring cannot be seen through the crystal or other transparent parts.

Other features and advantages of the invention will appear in the following description of different embodiments, given by way of non-limiting example with reference to the annexed drawings, in which FIG. 1 shows a first embodiment of a watch case according to the invention, seen in cross-section along the line I—I of FIG. 2;

Figure 1:
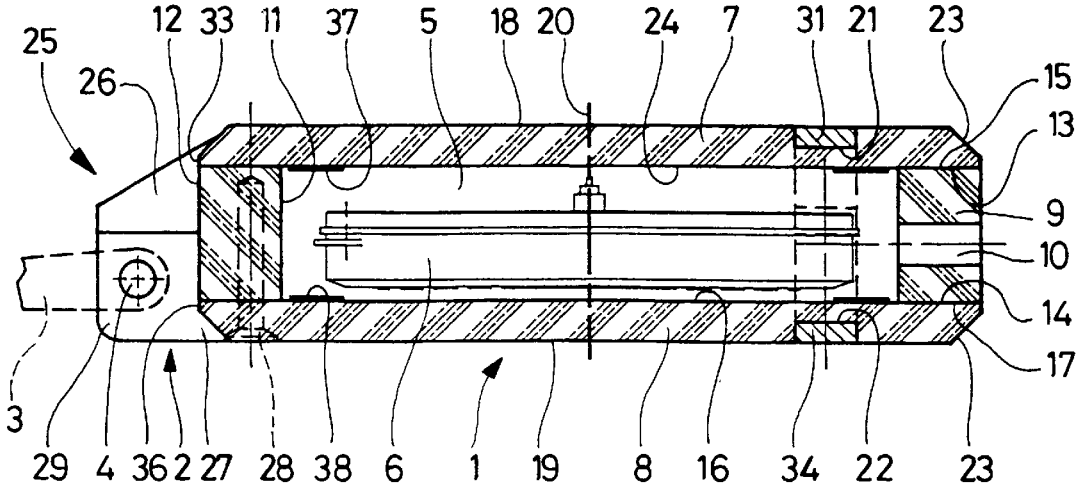
Figure 2:
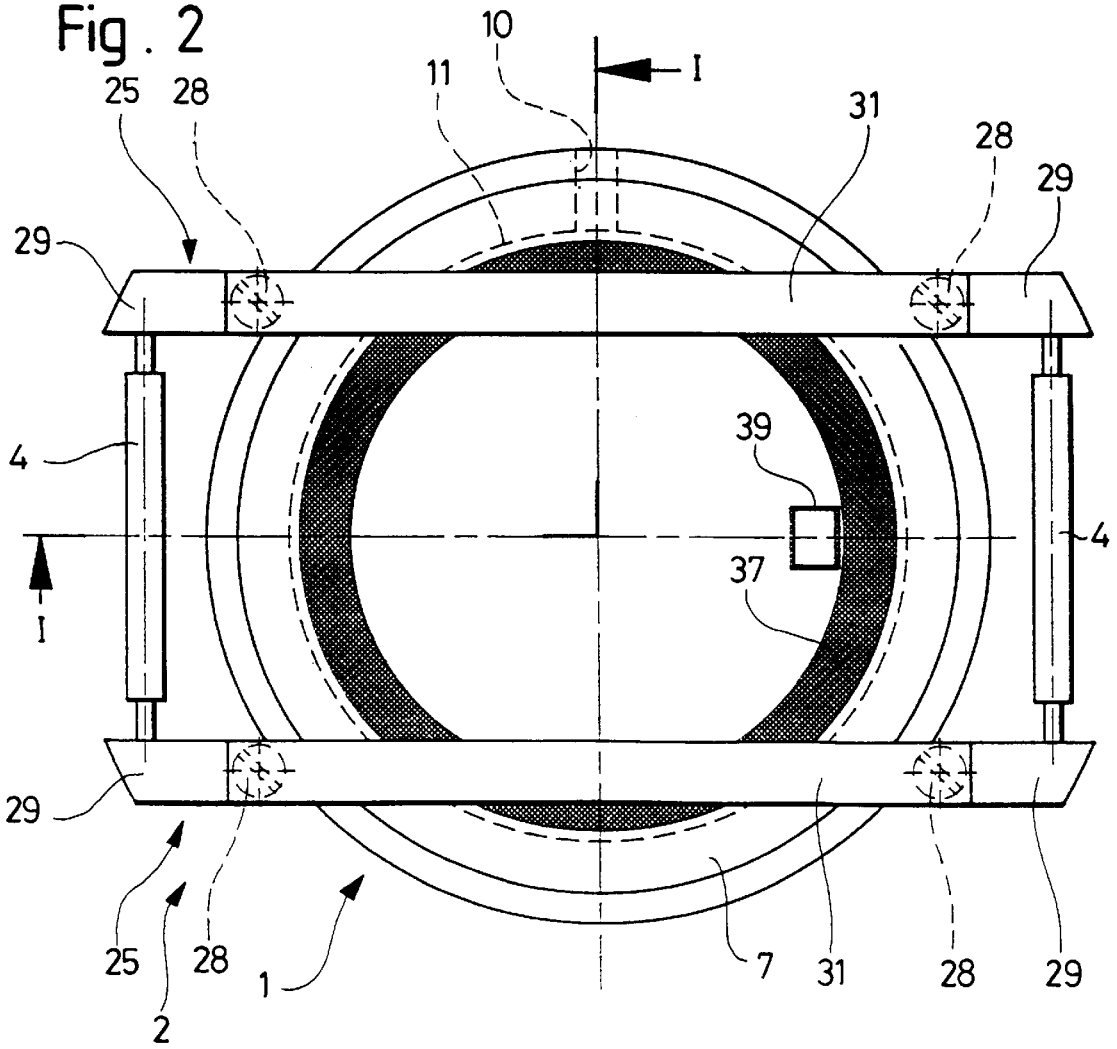
FIG. 2 is a top view of the case of FIG. 1.
Figure 3:
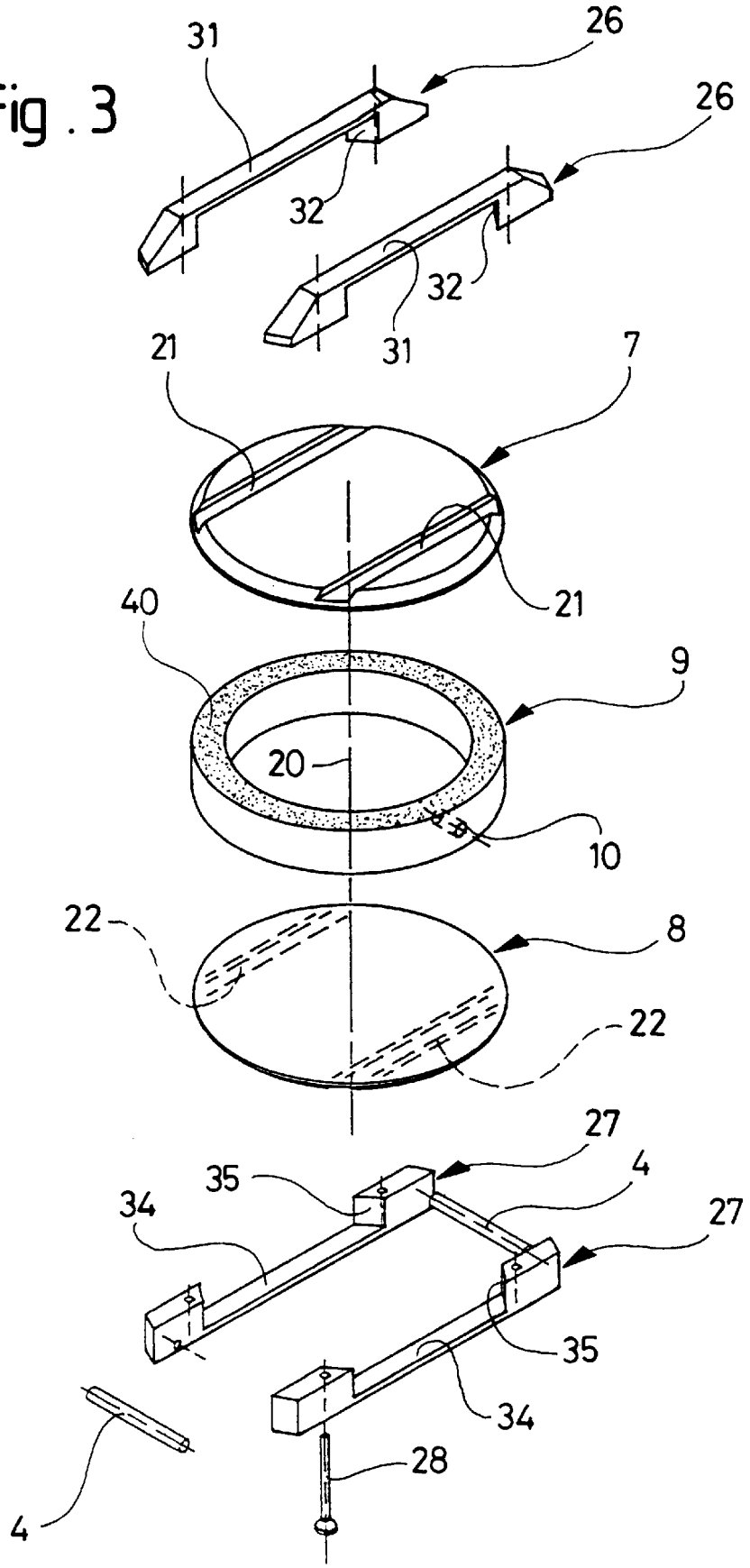
FIG. 3 is a exploded view of the main components of FIGS. 1 and 2.

The watch case illustrated by FIGS. 1 to 3 includes a casing 1, made of several parts of hard materials, and a support device 2 arranged for holding together the casing parts and for connecting the case to fixing means which, in the present case, comprise a wristlet 3 whose ends are attached to the case by means of conventional lugs 4. Casing 1 has here a circular shape and defines a sealed cylindrical housing 5 intended to contain a watch movement 6 fitted with display elements, for example hands (not shown).

In the present case, casing 1 consists of three parts, namely a transparent upper plate forming a crystal 7, a lower plate forming a back cover 8, and an annular intermediate part forming a middle part 9 and preferably including a lateral hole 10 for the passage of a control stem (not shown) for movement 6. In plane, the three parts 7, 8, 9 have here the same circular shape and the same external dimensions. In a preferred embodiment, offering a particularly attractive aesthetic appearance, these three parts are made of sapphire, and are thus transparent. Back cover 8 may advantageously be identical to crystal 7.

The three parts 7, 8, 9 have particularly simple external shapes, in order to facilitate the manufacture thereof and in particular to reduce and simplify machining and polishing operations. Middle part 9 is an annular cylinder obtained by transverse sawing of a sapphire tube manufactured by extrusion. Its inner wall 11 and its outer wall 12 are cylindrical and have no recess, apart from hole 10. Its-upper and lower faces are flat and polished to form contact surfaces 13 and 14 onto which crystal 7 and back cover 8 are respectively applied. Lower face 24 of crystal 7 is entirely flat; in proximity to its outer edge, it is polished to form a contact surface 15 which is applied in a sealed manner onto contact surface 13 of middle part 9. Likewise, the upper plane face 16 of back cover 8 is polished in proximity to its outer edge to form a contact surface 17 which is applied in a sealed manner onto contact surface 14 of the middle part. Thus, sealing of casing 1 is assured at the junction points between parts 7, 8 and 9 as long as these parts are held pressed together, as a result of the absence of porosity of the material and the polishing of their mutual contact surfaces 13 and 15, 14 and 17 without it being necessary to insert a sealing gasket, nor to glue the parts to each other.

In order to avoid the appearance of interference fringes (Newton rings) by reflection on transparent middle part 9, an antireflective coating 40 (FIG. 3) is applied to polished contact surfaces 13 and 14. Moreover, it is possible to add an inlaid decoration in a portion of these same surfaces, provided that there remains a portion of continuous polished surface beside the decoration, capable of guaranteeing sealed or water resistant contact with crystal 7 or back cover 8.

Upper face 18 of crystal 7 and lower face 19 of back cover 8 are also flat and perpendicular to the central axis 20 of the casing, but in this example they each include two parallel grooves 21, 22 in which support device 2 engages, as will be described hereinafter. These grooves preferably have a rectangular cross-section and can be machined in a relatively inexpensive manner. Moreover, a truncated chamfer 23 is arranged around crystal 7 and back cover 8.

It is to be noted that, as a result of their simple geometrical shapes described hereinbefore, parts 7, 8 and 9 of casing 1 can be manufactured in hard materials without prohibitive costs. In particular, these parts have no projecting portions and/or hollows intended to form encasing elements. Moreover, they do not need grooves for housing sealing gaskets.

Support device 2 includes, in addition to lugs 4, two rigid metal clamps 25 disposed parallel to each other in vertical planes, i.e. parallel to central axis 20 of casing 1. Each clamp 25 includes an upper portion 26 and a lower portion 27 which are assembled by means of two axial screws 28 which tend to grip casing 1 against the two portions of the clamp, thus forming a closed frame. As is seen in FIG. 2, the four screws 28 may advantageously be situated outside casing 1, thus they do not require holes in the casing. Their heads are preferably embedded in the lower face of the clamp. The superposed ends of the two portions 26 and 27 of each clamp form horns 29 for attaching wristlet 3, the ends of lugs 4 engaging in holes preferably arranged in lower portion 27 of the clamp.

As FIG. 3 shows, the median portion of upper portion 26 of each clamp has the shape of a rectangular bar 31 which is housed in groove 21 of crystal 7 and has the same dimensions as said groove, so that clamp 25 is flush with upper face 18 of the crystal. The thickest ends of portion 26 each have a vertical shoulder 32 disposed obliquely for being applied against external peripheral surfaces 33 and 12 of crystal 7 and middle part 9 which holds these two parts in axial alignment. Likewise, lower portion 27 of each clamp 25 includes a central bar 34 which is housed in the corresponding groove 22 of back cover 8, and oblique shoulders 35 which abut against the respective peripheral surfaces 36 and 12 of back cover 8 and middle part 9. As the two clamps 25 are sufficiently spaced apart to let the watch dial appear between them, their oblique shoulders 32 and 35 are distributed on the periphery of casing 1 and thus hold the casing parts in any lateral direction. Thus, support device 2 fulfills a triple function: axial gripping of the stacked parts of casing 1, lateral holding of these three parts, and connection between the two ends of the wristlet and the casing.

In FIGS. 1 and 2, it is also seen that annular metallized zones 37 and 38 are provided respectively on lower face 24 of crystal 7 and upper face 16 of back cover 8, in proximity to the periphery of housing 5, to allow certain conventional positioning elements for movement 6 to be glued at this location, for example a casing ring and a flange (not shown). These metallized zones also play an aesthetic role by masking the aforecited elements. Other metallized elements may also be provided, in particular frame 39 shown in FIG. 2 and intended to cover the edge of a window arranged in the dial of movement 6.

Sealing at the passage of the control stem into hole 10 of middle part 9 can be assured by a conventional "O" ring sealing gasket.

Although the example described hereinbefore refers to a casing 1 made entirely of sapphire (or corundum), a similar structure can be used with other materials, with or without a high level of hardness. For example, crystal 7 could be made of any other transparent crystal, or of mineral glass. Middle part 9 could also be made of mineral glass, ceramics, hard metal or generally of any kind of hard material manufactured in particular by molding and sintering. Similar materials can be used to make back cover 8. To the extent that these materials can be polished to form optical flat regions, i.e. very smooth non-porous or closed surfaces, it is possible to assure sealing of the casing without sealing gaskets, as described hereinbefore. Moreover, it will be noted that middle part 9 could be made integral with crystal 7 or back cover 8. For example, a back cover—middle part made by molding and sintering would only have to be machined for polishing contact surface 13 and piercing hole 10. This hole could even be omitted if contactless time-setting means are used, for example by using radio or magnetic driving means.

Figure 4:
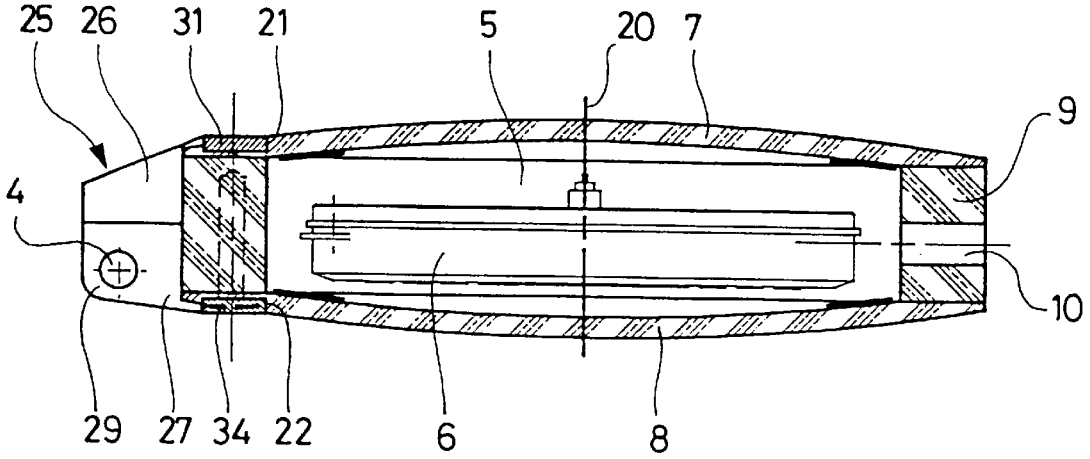
FIG. 4 shows a second embodiment of a watch case according to the invention, seen in cross-section along the line IV—IV of FIG. 5.
Figure 5:
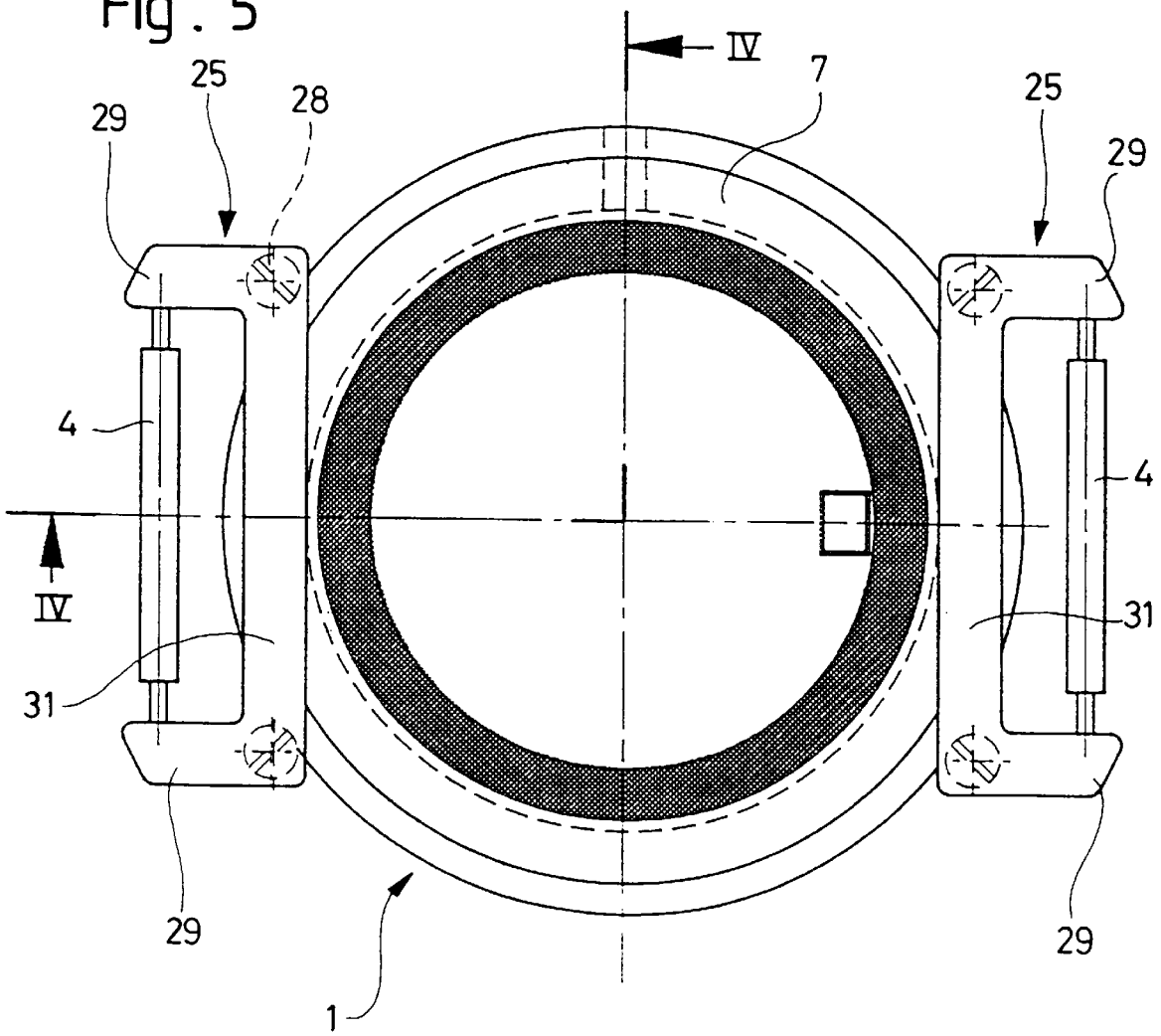
FIG. 5 is a top view of the watch case of FIG. 4.

Another embodiment of a watch case according to the invention is illustrated by FIGS. 4 and 5, where the same reference numbers have been used as in the preceding example for the equivalent elements, even if their shapes or arrangements are different. In this case, crystal 7 and back cover 8 are convex, but solely for aesthetic reasons. Middle part 9 is identical to that of the preceding example. Conversely, the two clamps 25 have a different shape to the preceding example, since each of them carries one of lugs 4 via its ends bent at a right angle to form two horns 29. Its two bars 31 and 34 are parallel to lug 4, as are corresponding grooves 21 and 22 of crystal 7 and back cover 8. The tension of the wristlet is thus transmitted from one clamp 25 to the other via the crystal and the back cover.

With respect to the preceding example, this design has the advantage of better clearing the central portion of casing 1, in particular to allow movement 6 to be seen.

Figure 6:
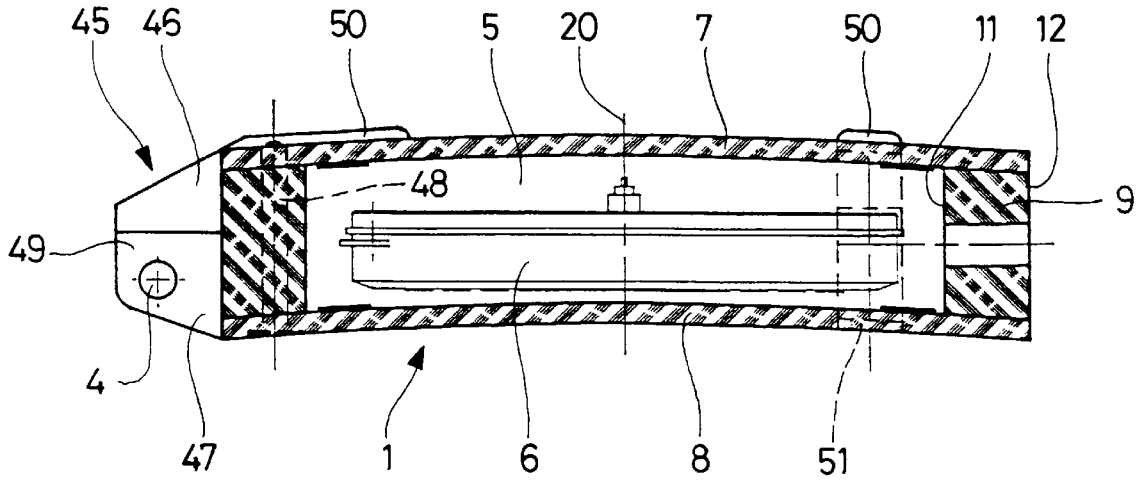
FIG. 6 shows a third embodiment of a watch case according to the invention, seen in cross-section along the line VI—VI of FIG. 7.
Figure 7:
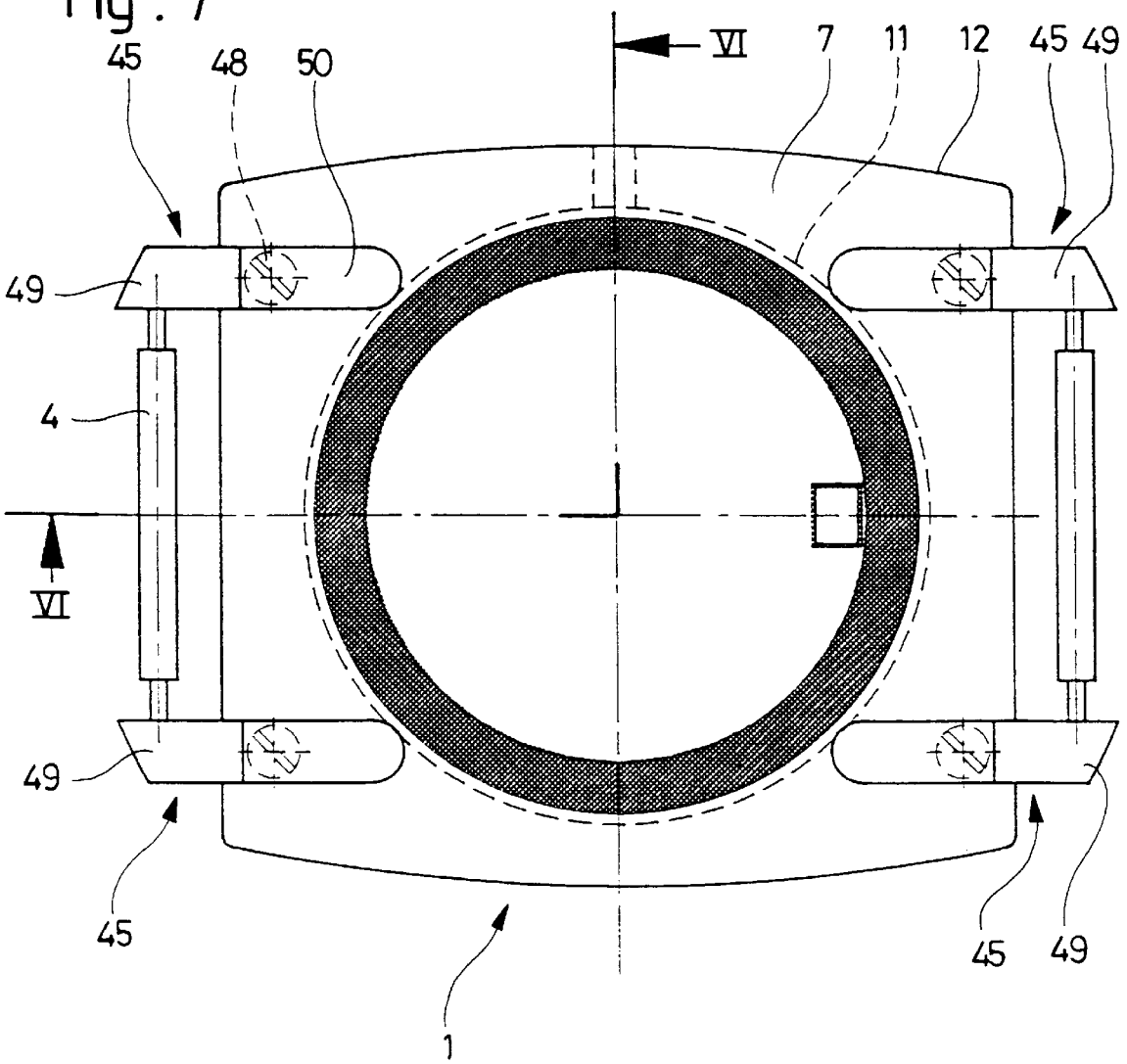
FIG. 7 is a top view of the case of FIG. 6.

In the embodiment illustrated by FIGS. 6 and 7, the external shape of casing 1 is substantially rectangular in plane. Nonetheless, inner wall 11 and outer wall 12 of middle part 9 also have in this case generatrices parallel to axis 20 of the casing, so that the middle part can be manufactured from a tubular part. Crystal 7 is convex and back cover 7 is concave, both following a spherical contour, so that their contact surfaces with middle part 9 also have the same spherical shape, which may be machined and polished without any particular difficulty.

The support device includes here four clamps 45 each formed of an upper portion 46 abutting against the crystal, a lower portion 47 abutting under the back cover and an axial screw 48 which passes through the three parts 7, 8, 9 of casing 1 and assures axial gripping of these parts, as well as holding clamp 45 onto the casing. Clamps 45 are arranged parallel in pairs on the opposite ends of the casing to form two pairs of horns 49 supporting lugs 4. Upper portions 46 and lower portions 47 of each clamp have respective claws 50 and 51 which, preferably, are engaged in corresponding external grooves of crystal 7 and back cover 8, as in the example of FIGS. 1 to 3. However, these grooves are not indispensable, since positioning of each clamp 45 can be assured by abutting against the casing and by screws 48 engaged in the corresponding holes of the casing. The support device shown here is advantageous when the crystal and the back cover are both transparent, since it does not mask housing 5 containing movement 6 at all, or when certain of the casing parts are not made of hard material and can thus be pierced easily.

I claim:

1. A watch case including a water resistant casing formed of several stacked parts, which together define a housing intended to contain a watch movement, and a support device which keeps said casing parts assembled, the casing having a transparent upper face, the support device including at least one rigid clamp formed of an upper portion and a lower portion which are removably fixed to each other by assembly means arranged to produce gripping of the casing between the two portions of the clamp in an axial direction, perpendicular to said lower face, wherein;

said casing parts are made of materials having zero porosity or a closed structure and have, facing each other, mutual contact surfaces which are flat or generated by revolution and are polished, no sealing gasket being inserted between them.

2. A watch case according to claim 1, wherein said parts of the casing include a transparent upper plate forming a crystal, a lower plate forming a back cover, and an annular intermediate part forming a middle part.

3. A watch case according to claim 1, wherein said assembly means include screws arranged in the axial direction.

4. A watch case according to claim 1, wherein the clamp also abuts against external peripheral surfaces of each casing part, so that it holds these parts laterally.

5. A watch case according to claim 1, wherein the support device includes attachment means for attaching a wristlet or other fixing means to the case.

6. A watch case according to claim 5, wherein the clamp forms a closed frame which extends substantially in a plane parallel to the axial direction.

7. A watch case according that to claim 5, wherein the lower portion of the clamp extends in at least one groove arranged in the lower face of the casing and is substantially flush with this face.

8. A watch case according to claim 5 wherein the upper portion of the clamp extends in at least one groove arranged in the upper face (18) of the casing and is substantially flush with said face.

9. A watch case according to claim 6, wherein the support device includes two of said clamps, arranged parallel to each other and said attachment means include two lugs arranged perpendicular to the clamps, each lug being fixed to ends of the two clamps.

10. A watch case according to claim 7, wherein the support device includes two of said clamps, each having two bent ends which together carry one of the attachment means.

11. A watch case according to claim 2, wherein all the casing parts are made of sapphire.

12. A watch case according to claim 2, wherein the middle part is made of sapphire, hard material, ceramics or glass.

13. A watch case according to claim 2, wherein the back cover is made of sapphire, hard metal or glass.

14. A watch case according to claim 2, wherein the middle part is transparent and includes an antireflective coating at least over its contact surface on the side of the crystal.

15. A watch case according claim 11, wherein the middle part has a cylindrical or prismatic annular shape and inner and outer lateral walls which have generatrices parallel to the axial direction and have no projections or recesses.

16. A watch case according to claim 15, wherein the crystal and the back cover have, in plane, substantially the same shape and the same external dimensions as the middle part.

17. A watch case according claim 12, wherein the middle part has a cylindrical or prismatic annular shape and inner and outer lateral walls which have generatrices parallel to the axial direction and have no projections or recesses.

18. A watch case according claim 17, wherein the crystal and the back cover have, in plane, substantially the same shape and the same external dimensions as the middle part.

19. A watch case according to claim 3, wherein the support device includes attachment means for attaching a wristlet or other fixing means to the case.

20. A watch case according to claim 4, wherein the support device includes attachment means for attaching a wristlet or other fixing means to the case.

* * * * *

UNITED STATES PATENT AND TRADEMARK OFFICE

CERTIFICATE OF CORRECTION

PATENT NO. : 5,901,117

DATED : May 4, 1999

INVENTOR(S) : Guy Delabre

It is certified that error appears in the above-indentified patent and that said Letters Patent is hereby corrected as shown below:

Title page, item

[30] Foreign Application Priority Data

Oct. 3, 1996 [FR] France 96 12069

Signed and Sealed this

Twelfth Day of October, 1999

*Attest:*

Q. TODD DICKINSON

*Attesting Officer*

*Acting Commissioner of Patents and Trademarks*